US006333738B1

(12) United States Patent
Ide

(10) Patent No.: US 6,333,738 B1
(45) Date of Patent: Dec. 25, 2001

(54) DISPLAY PANEL DRIVING APPARATUS OF A SIMPLIFIED STRUCTURE

(75) Inventor: Shigeo Ide, Yamanashi (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/324,723

(22) Filed: Jun. 3, 1999

(30) Foreign Application Priority Data

Jun. 3, 1998 (JP) ..... 10-154986

(51) Int. Cl.[7] ..... G06G 5/00

(52) U.S. Cl. ..... 345/211; 345/211; 345/60; 345/76; 345/87; 315/169.3; 315/169.4

(58) Field of Search ..... 345/211–213, 60, 345/41, 204, 94–96, 100, 76, 208–210; 315/160, 169.3, 169.4

(56) References Cited

U.S. PATENT DOCUMENTS 4,958,105 * 9/1990 Young et al. ..... 315/169.3
5,414,443 * 5/1995 Kanatani et al. ..... 345/95
5,696,522 * 12/1997 Iwama ..... 345/60
5,717,437 * 2/1998 Sano et al. ..... 345/211

* cited by examiner

*Primary Examiner*—Lun-Yi Lao
(74) *Attorney, Agent, or Firm*—Sughrue Mion, PLLC

(57) ABSTRACT

A driving apparatus of a display panel performs a high speed operation with a construction having a small scale. The driving apparatus is constituted by a DC power source to generate a DC voltage, a first capacitor connected in parallel with the DC power source, a coil whose one end is connected to a positive side terminal of the DC power source, switching device which alternately connects and disconnects the other end of the coil to a negative side terminal of the DC power source, a diode whose anode is connected to the other end of the coil and whose cathode is connected to the negative side terminal of the DC power source, and a second capacitor connected in parallel with the diode. A change in electric potential occurring at the other end of the coil is outputted as a driving pulse.

9 Claims, 18 Drawing Sheets

SW1
OFF
ON
OFF

SW2
OFF
ON
OFF

SW3
OFF
ON
OFF

SW4
ON
OFF
ON

CURRENT FLOWING IN THE COIL L1
0

CURRENT FLOWING IN THE COIL L2
0
IPy
Vc

ELECTRIC POTENTIAL ON THE LINE 2
0

DISPLAY PANEL DRIVING APPARATUS OF A SIMPLIFIED STRUCTURE

BACKGROUND OF THE INVENTION

1. Field of the Invention

The present invention relates to a driving apparatus of a display panel having a capacitive load, such as a plasma display panel of an AC driving type (hereinafter, called PDP), an electro-luminescence display (hereinafter, called EL), or the like.

2. Description of Related Art

Display apparatuses that use a flat panel of a self light emission type such as PDP, EL, or the like, are commercially available as wall type TV sets.

FIG. 1 is a schematic diagram which shows the structure of a display apparatus of that type.

As FIG. 1 shows, a PDP 10 provided as a display panel comprises two sets of row electrodes $Y_1$ to $Y_n$ and $X_1$ to $X_n$. Two electrodes from each of these electrode sets together constitute a row electrode pair (X, Y) that corresponds to each row (the first row to the nth row) of one picture plane. In the PDP 10, column electrodes $Z_1$ to $Z_m$, which are arranged perpendicularly to the row electrode pairs are further provided so that the row electrodes and the column electrodes sandwich a dielectric layer and a discharge space which are not particularly shown in the figure. Each of the column electrodes $Z_1$ to $Z_m$ respectively corresponds to each column (the first column to the mth column) of one picture plane. One discharge cell $C_{(i, j)}$ is formed in an intersecting portion between a row electrode pair (X, Y) and a column electrode Z.

The display apparatus includes a pair of row electrode driving circuits 30 and 40.

At first, the row electrode driving circuit 30 generates a reset pulse $RP_y$ of a positive voltage as shown in FIGS. 2C to 2F and applies it to the row electrodes $Y_1$, to $Y_n$, simultaneously. At the same time, the row electrode driving circuit 40 generates a reset pulse $RP_x$ of a negative voltage as shown in FIG. 2B, and simultaneously applies it to all of the row electrodes $X_1$ to $X_n$.

By applying the reset pulses $RP_x$, and $RP_y$ simultaneously, all of the discharge cells of the PDP 10 are excited to discharge and charged particles are generated. After the discharge is terminated, a predetermined amount of wall charges are uniformly formed in the dielectric layer of all of the discharge cells (resetting stage).

After the completion of the resetting stage, a column electrode driving circuit 20 of the display apparatus generates pixel data pulses $DP_1$ to $DP_n$ according to pixel data corresponding to the first row to the nth row of the picture plane and sequentially applies them to the column electrodes $Z_1$ to $Z_m$ as shown in FIG. 2A. The row electrode driving circuit 30 generates a scanning pulse SP of a negative voltage in accordance with the timing of the application of the pixel data pulses $DP_1$ to $DP_n$ and sequentially applies it to the row electrodes $Y_1$ to $Y_n$, as shown in FIGS. 2C to 2F.

Among the discharge cells that belong to the row electrodes to which the scanning pulse SP has been applied, a discharge occurs in those discharge cells to which the pixel data pulse of the positive voltage has been simultaneously applied. As a result the discharge, most of the wall charges are extinguished. Conversely, no discharge occurs in those discharge cells to which the scanning pulse SP has been applied but the pixel data pulse of the positive voltage is not applied. The wall charges remain unchanged in those discharge cells. In this way, the discharge cell in which the wall charges remain becomes a light-emission discharge cell and the discharge cell in which the wall charges have been extinguished becomes a non-light emission discharge cell (addressing stage).

After the addressing stage has finished, the row electrode driving circuits 30 and 40 continuously apply a sustaining pulse $IP_y$ of the positive voltage to each of the row electrodes $Y_1$ to $Y_n$ as shown in FIGS. 2C to 2F. The row electrode driving circuits 30 and 40 also continuously apply a sustaining pulse $IP_x$ of the positive voltage to each of the row electrodes $X_1$ to $X_n$ at a timing deviated from the timing of the application of the sustaining pulse $IP_y$, as shown in FIG. 2B.

For a period of time during which the sustaining pulses $IP_x$ and $IP_y$ are alternately applied, the discharge light emission is repeated by the light emission discharge cells in which the wall charges remain, thereby the light emitting state is sustained (sustaining discharge stage).

A drive control circuit 50 is provided shown in FIG. 1. Based on the timing of a supplied video signal, the drive control circuit 50 generates various switching signals for generating various driving pulses as shown in FIG. 2. The generated switching signals are supplied to the column electrode driving circuit 20 and the row electrode driving circuits 30 and 40.

The column electrode driving circuit 20 and the row electrode driving circuits 30 and 40 generate various driving pulses shown in FIGS. 2A to 2F in accordance with the switching signals supplied from the drive control circuit 50.

FIG. 3 is a diagram showing a driving pulse generating circuit which is provided in the row electrode driving circuit 30 and generates the reset pulse $RP_y$ and sustaining pulse $IP_y$.

As FIG. 3 shows, the driving pulse generating circuit has a capacitor C1 whose one end is connected to a PDP grounding potential $V_s$ as a grounding potential of the PDP 10. The driving pulse generating circuit also includes a plurality of switching elements S1 through S4 which are arranged in the manner as shown in the figure.

The switching element S1 is in an OFF state for a period in which a switching signal SW1 of the logic level "0" is supplied from the drive control circuit 50. When the logic level of the switching signal SW1 is equal to "1", the switching element S1 is in a connection state and an electric potential generated at the other end of the capacitor C1 is applied onto a line 2 via a coil L1 and a diode D1. The capacitor C1, consequently, starts discharging and an electric potential generated by the discharge is applied onto the line 2.

The switching element S2 is in the OFF state for a period in which a switching signal SW2 of the logic level "0" is supplied from the drive control circuit 50. The switching element S2 is in the connection state when the logic level of the switching signal SW2 is equal to "1" and the potential on the line 2 is applied to the other end of the capacitor C1 via a coil L2 and a diode D2. That is, the capacitor C1 is charged by the potential on the line 2.

The switching element S3 is in the OFF state for a period in which a switching signal SW3 of the logic level "0" is supplied from the drive control circuit 50. When the logic level of the switching signal SW3 is equal to "1", the switching element S3 is in the connecting state and a positive side terminal potential $V_c$ of a DC power source B1 is applied onto the line 2. The PDP grounding potential $V_s$ is applied to a negative side terminal of the DC power source B1.

The switching element S4 is in the OFF state for a period in which a switching signal SW4 of the logic level "0" is supplied from the drive control circuit 50. When the logic level of the switching signal SW4 is equal to "1", the switching element S4 is in the connection state and the PDP grounding potential $V_s$ is applied onto the line 2.

The line 2 is connected to the row electrodes Y in the PDP 10 that has a load capacitance C0. In the row electrode driving circuit 30, the circuits as shown in FIG. 3 are provided for n systems that correspond to the number of row electrodes $Y_1$ to $Y_n$.

FIGS. 4A to 4G are diagrams showing timings of the switching signals SW1 to SW4 which are supplied to the row electrode driving circuit 30 shown in FIG. 3 from the drive control circuit 50 so as to generate the sustaining pulse $IP_y$ as shown in FIGS. 2C to 2F onto the line 2.

As shown in FIGS. 4A to 4D, only the switching signal SW4 among the switching signals SW1 to SW4 has the logic level "1" at first. So, the switching element S4 is in the connection state and the PDP grounding potential $V_s$ is applied onto the line 2. During this period, the potential on the line 2 is equal to the PDP grounding potential $V_s$, that is, 0 [V].

When the switching signal SW4 is subsequently turned to the logic level "0" and the switching signal SW1 is turned to the logic level "1", only the switching element S1 is in the connection state, so that the charges accumulated in the capacitor C1 are discharged. Consequently, a current transiently flows into the coil L1 in such a form as shown in FIG. 4E. The current flows into the PDP 10 through the diode D1, switching element S1, and line 2 to charge the load capacitance $C_O$, so that the potential on the line 2 gradually increases as shown in FIG. 4G.

When the switching signal SW1 is switched to the logic level "0" and the switching signal SW3 is switched to the logic level "1", only the switching element S3 is in the connecting state and the positive side terminal potential $V_c$ of the DC power source B1 is applied onto the line 2. Therefore, the potential on the line 2 is fixed to $V_c$ for this period of time, as shown in FIG. 4G.

When the switching signal SW2 is switched to the logic level "1" and the switching signal SW3 is switched to the logic level "0", only the switching element S2 enters into the connection state and a negative current transiently flows in the coil L2 in the form as shown in FIG. 4F. The load capacitance $C_O$ of the PDP 10 charged as mentioned above is discharged and the current flows into the capacitor C1 via the line 2, coil L2, diode D2, and switching element S2, to be retrieved therein. Consequently, the potential on the line 2 decreases gradually as FIG. 4G shows.

By the above mentioned operations, the sustaining pulse $IP_y$of the positive voltage as shown in FIG. 4G is applied onto the line 2.

With the circuit having the structure shown in FIG. 3, there however is a problem that the circuit scale becomes large because of the necessity of the use of the four switching elements S1 to S4.

It is conceivable to implement each of the switching elements S1 to S4 by an MOS transistor. Even in such a case, a dedicated power source has to be prepared for the switching and driving of the switching elements S1 to S3 among the switching elements S1 to S4. This is because, the MOS transistors cannot be switched directly by the switching signals SW1 to SW3 since the electric potential which is applied across each of the switching elements S1 to S3 is in a floating state for each of the switching signals SW1 to SW3 as shown in FIG. 3.

For example, when the switching element S1 is formed by an MOS transistor, therefore, it actually has such a structure as shown in FIG. 5.

Specifically, an MOS transistor Q is connected between the diode D1 and the line 2 shown in FIG. 3 and, to allow the MOS transistor Q to perform the switching operation in response to the switching signal SW1, photocoupler PC, power source B2, and driver DV are further necessary. When the switching signal SW1 has the logic level "1", the driver DV supplies an electric potential $V_{DD}$ on the high potential side in the power source B2 to a gate terminal of the MOS transistor Q. When the switching signal SW1 has the logic level "0", an electric potential $V_0$ on the low potential side in the power source B2 is supplied to the gate terminal. The potential $V_0$ is always applied to a drain terminal of the MOS transistor Q. The photocoupler PC electrically insulates the logic level of the switching signal SW1 and relays it to the driver DV.

When the switching elements S1 to S3 are implemented by the MOS transistors in the construction shown in FIG. 3 as mentioned above, an additional circuit as shown in FIG. 5 is necessary. This causes problems that the circuit scale becomes large and the operating speed decreases.

OBJECT AND SUMMARY OF THE INVENTION

The invention is made to solve the problems and it is an object to provide a display panel driving apparatus which can operate at a high speed with a simplified construction.

According to the invention, there is provided a display panel driving apparatus for generating driving pulses to be applied to each of a plurality of row electrodes and a plurality of column electrodes of a display panel, the plurality of column electrodes being arranged to be perpendicular to the row electrodes, comprising: a DC power source for generating a DC voltage; a first capacitor connected in parallel with the DC power source; a coil whose one end is connected to a positive side terminal of the DC power source; switching means for alternately performing a connection and a disconnection between the other end of the coil and a negative side terminal of the DC power source; a diode whose cathode is connected to the other end of the coil and whose anode is connected to the negative side terminal of the DC power source; and a second capacitor connected in parallel with the diode, wherein an electric potential change developing at the other end of the coil is outputted as a driving pulse.

DETAILED DESCRIPTION OF THE PREFERRED EMBODIMENT

Figure 6:
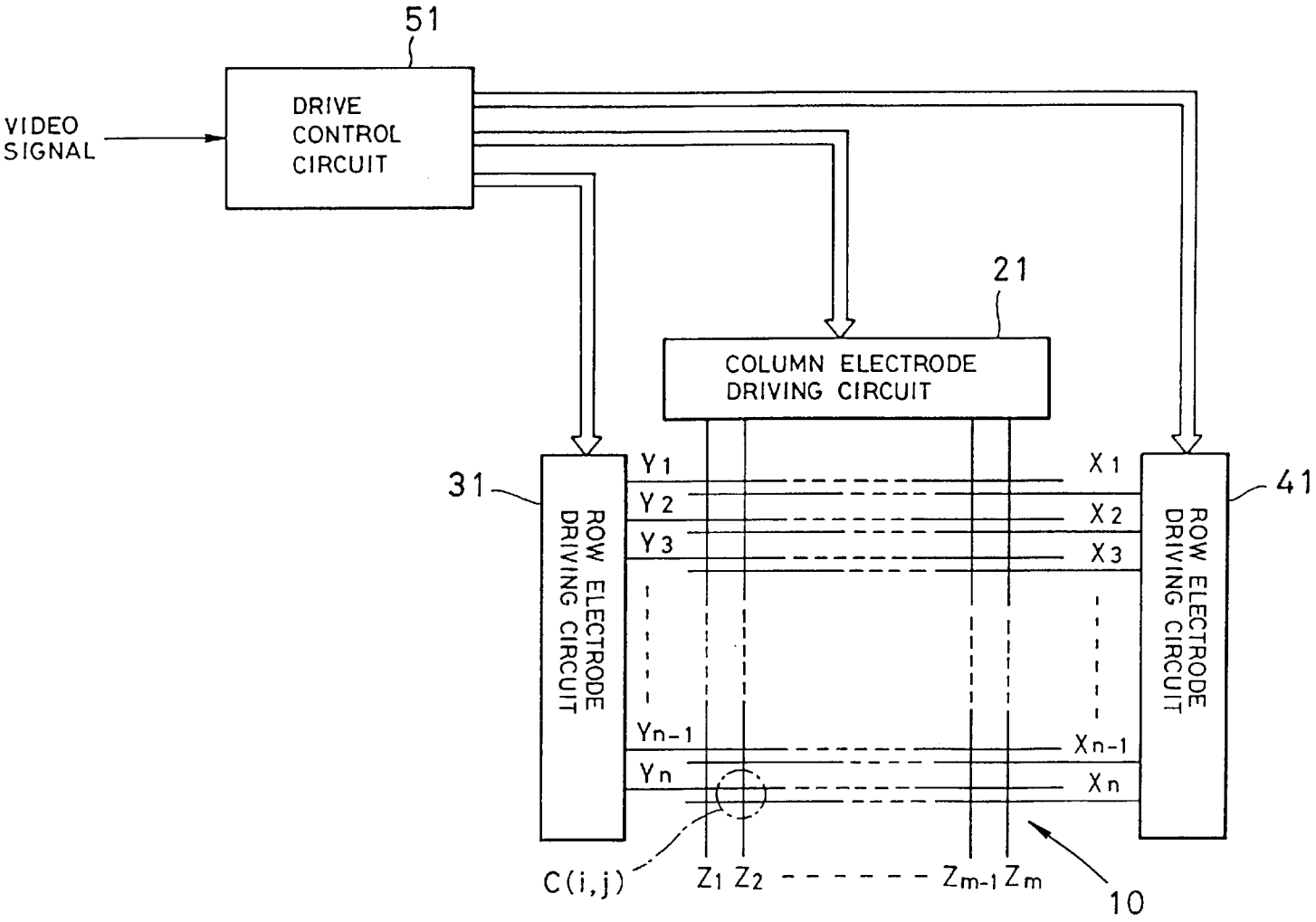
FIG. 6 is a diagram schematically showing the construction of a display apparatus having a driving apparatus of the invention.

FIG. 6 is a diagram showing the construction of a display apparatus having a driving apparatus of a display panel according to the invention.

In FIG. 6, the PDP 10 as a display panel has the two sets of row electrodes $Y_1$ to $Y_n$ and $X_1$ to $X_n$. Two electrodes from each of the two electrode sets constitute a row electrode pair (X, Y) that corresponds to each row (the first row to the nth row) of one picture plane. Furthermore, the PDP 10 is provided with the column electrodes $Z_1$ to $Z_m$ which are perpendicular to the row electrode pairs so as to sandwich a dielectric layer and a discharge space (not particularly shown in the figure) together with the row electrodes. Each of these column electrodes $Z_1$ to $Z_m$ respectively corresponds to each column (the first column to the mth column) of one picture plane. One discharge cell $C_{(i,j)}$ is formed in an intersecting portion of one row electrode pair (X, Y) and one column electrode Z.

Figures 2A, 2B, 2C, 2D, 2E, 2F, 2G:
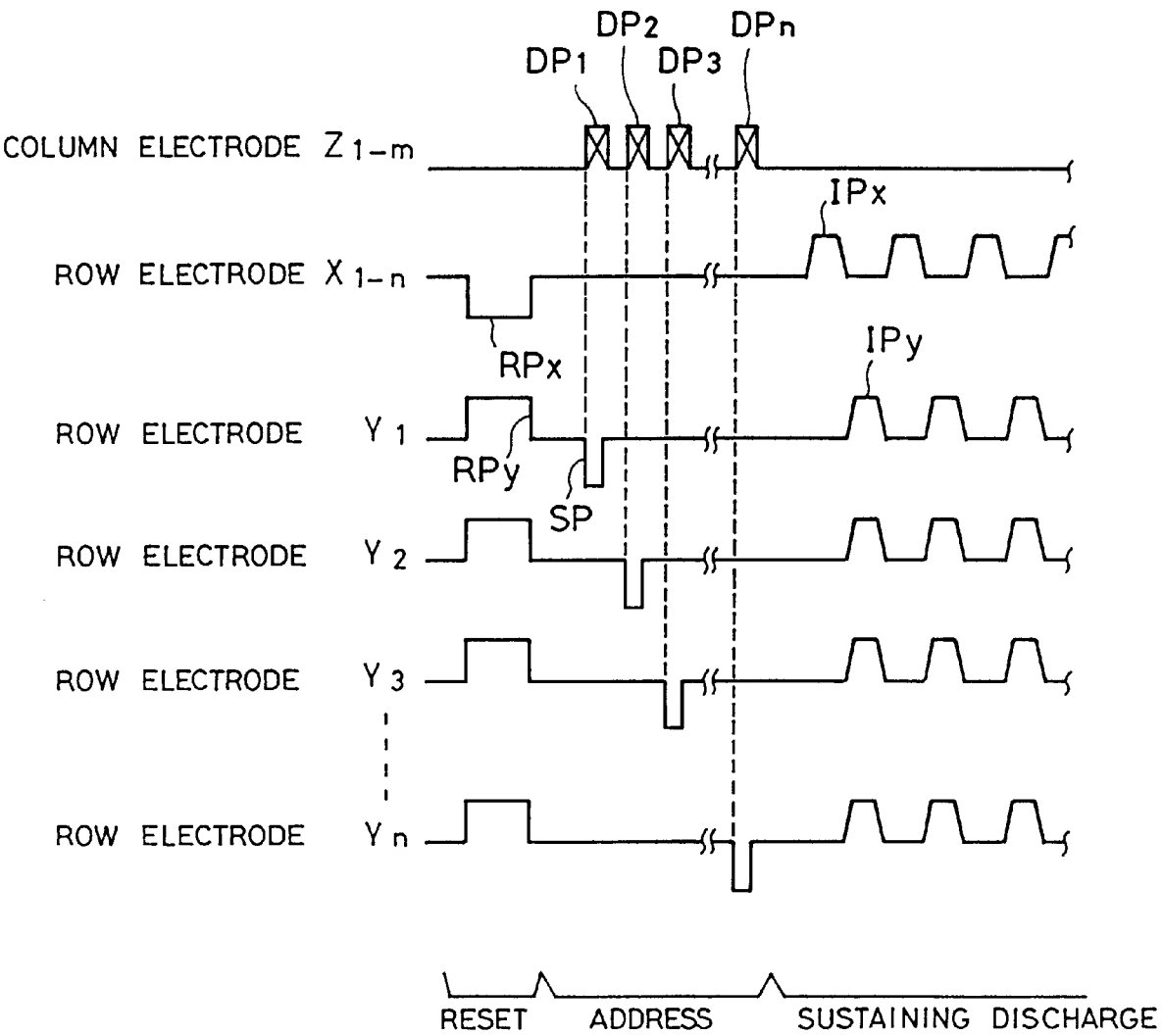
FIGS. 2A to 2G are diagrams showing the timing of applying various driving pulses.

A row electrode driving circuit 31 generates each of the reset pulse $RP_y$ of a positive voltage, the scanning pulse SP of a negative voltage, and the sustaining pulse $IP_y$ as shown in FIGS. 2C to 2F and supplies them to each of the row electrodes $Y_1$ to $Y_n$ at timings shown in FIG. 2A. A row electrode driving circuit 41 generates the reset pulse $RP_x$ of a negative voltage and the sustaining pulse $IP_x$ of a positive voltage as shown in FIG. 2B and supplies them to each of the row electrodes $X_1$ to $X_n$ at timings shown in FIG. 2B.

A column electrode driving circuit 21 generates the pixel data pulses $DP_1$ to $DP_n$ according to the pixel data corresponding to the first to nth rows of the picture plane and sequentially supplies them to the column electrodes $Z_1$ to $Z_m$ as shown in FIG. 2A.

Based on the supplied video signal, a drive control circuit 51 generates various switching signals to form various driving pulses as shown in FIGS. 2A to 2F, and supplies them to each of the column electrode driving circuit 21 and row electrode driving circuits 31 and 41.

Figure 7:
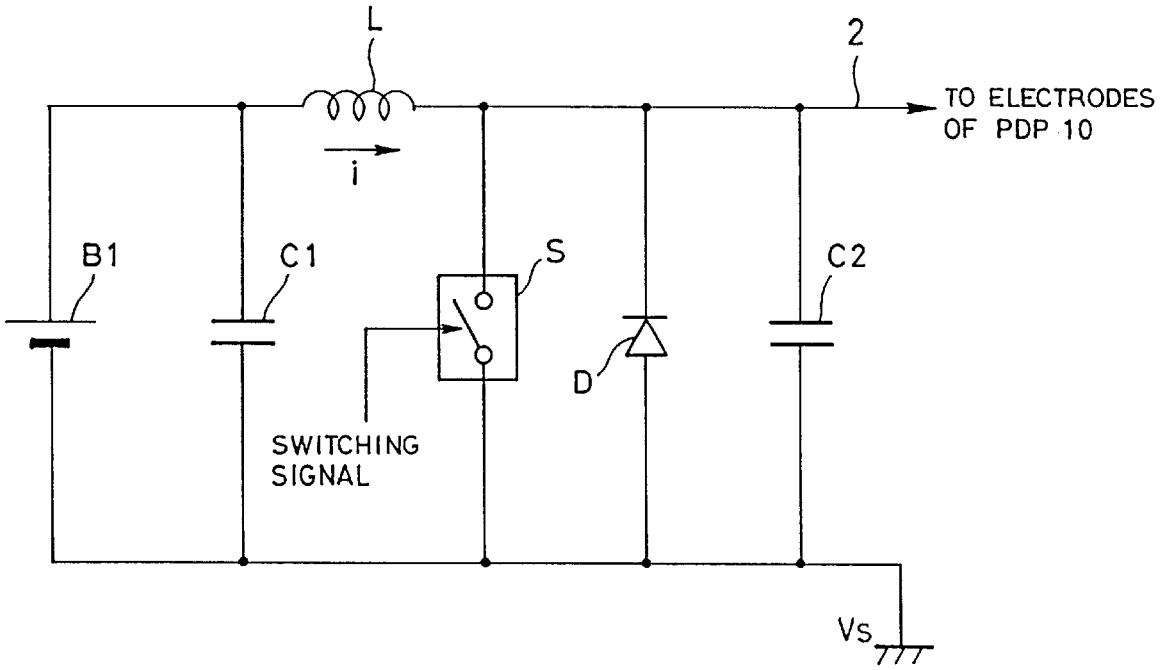
FIG. 7 is a diagram showing a flyback pulse output circuit as a driving apparatus according to the invention.

A flyback pulse output circuit as a driving apparatus according to the invention as shown in FIG. 7 is provided in each of the row electrode driving circuit 31, row electrode driving circuit 41, and column electrode driving circuit 21.

In FIG. 7, a negative side terminal of the DC power source B1 to generate a DC voltage is connected to the PDP grounding potential Vs as a grounding electric potential of the PDP 10. A voltage value of the DC power source B1 is set to a value lower than the peak value of each of the various driving pulses to be applied to the electrodes of the PDP 10. The capacitor C1 is connected in parallel with the DC power source B1. Furthermore, one end of a coil L is connected to a positive side terminal of the DC power source B1. The other end of the coil L is connected to each electrode (row electrode or column electrode) of the PDP 10 through the line 2. A switching element S performs a connection and a disconnection between the other end of the coil L and the negative side terminal of the DC power source B1 in response to a switching signal supplied from the drive control circuit 51.

Furthermore, a diode D whose cathode is connected to the other end of the coil L and whose anode is connected to the negative side terminal of the DC power source B1 is provided. A capacitor C2 is connected in parallel with the diode D. As shown in FIG. 7, the negative side terminal of the DC power source B3, the switching element S, the anode of the diode D, and one end of each of the capacitors C1 and C2 are connected to the PDP grounding potential Vs. A capacitance of the capacitor C1 is set to a value which is sufficiently larger than that of the capacitor C2 and the load capacitance C0 of the PDP 10.

The operation of the flyback pulse output circuit shown in FIG. 7 will now be described hereinafter with reference to FIGS. 8A to 8C and 9A to 9E.

Figures 8A, 8B, 8C:
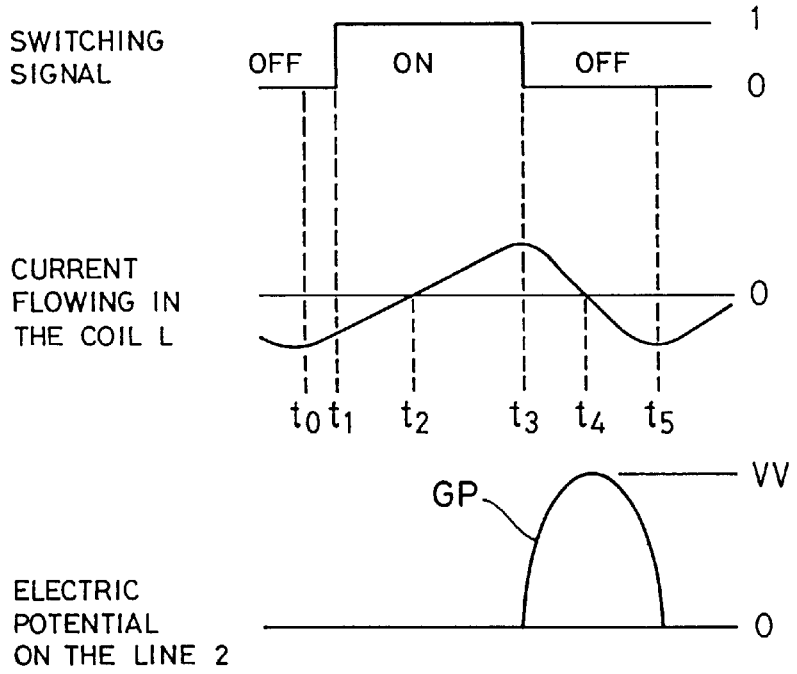
FIGS. 8A to 8C are operation waveform diagrams of the flyback pulse output circuit shown in FIG. 7.

Firstly, at the time points $t_0$ to $t_1$ shown in FIG. 8B, the switching element S is in an OFF state for a period of time when the switching signal supplied from the drive control circuit 51 is set to the logic level "0". The diode D is, therefore, biased in the forward direction. Due to the resonances of the capacitor C1 and coil L, a current flows in a path of the capacitor C1 -diode D -coil L shown by a bold arrow in FIG. 9A, and decreases gradually.

Subsequently, at time points $t_1$ to $t_3$ shown in FIG. 8B, when the switching signal supplied from the drive control circuit 51 is shifted to the logic level "1", the switching element S is turned on. After the time point $t_2$, shown by a bold arrow in FIG. 9B, the direction of the current flowing between the capacitor C1 and the diode D is reversed. As shown in FIG. 8B, its current amount gradually increases and an energy is accumulated in the coil L.

Figure 9A:
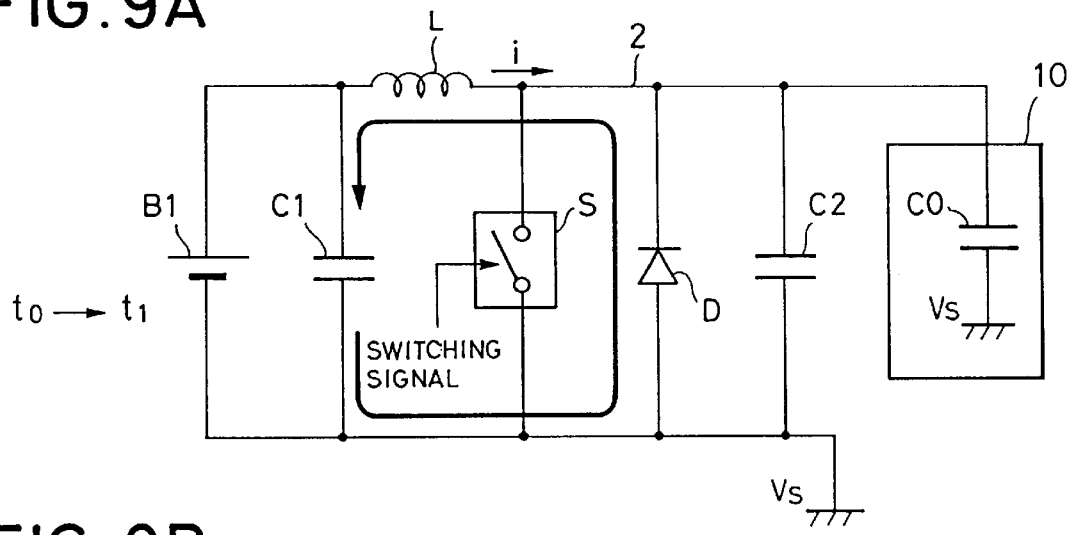
FIGS. 9A to 9E are diagrams for explaining the operation of the flyback pulse output circuit shown in FIG. 7.
Figure 9B:
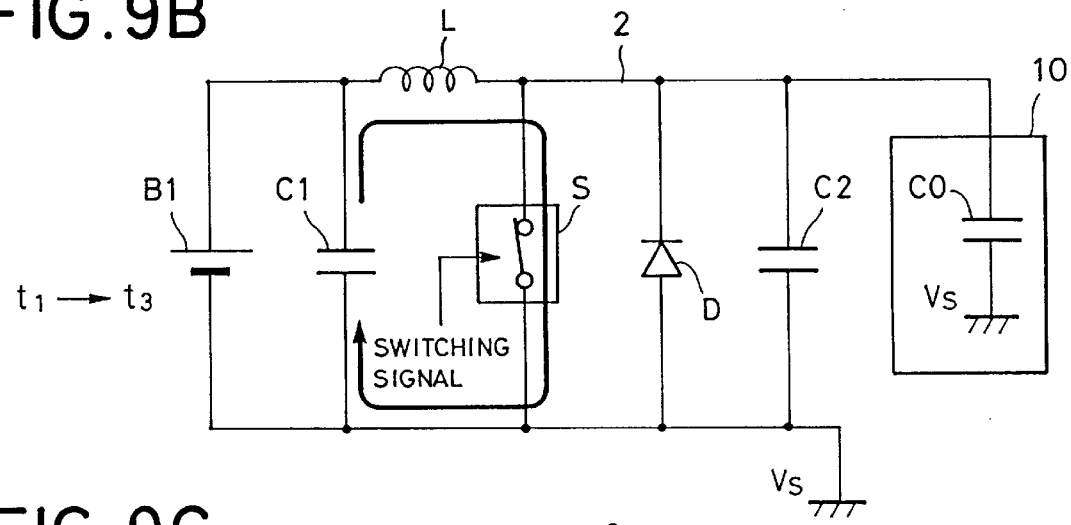
Figure 9C:
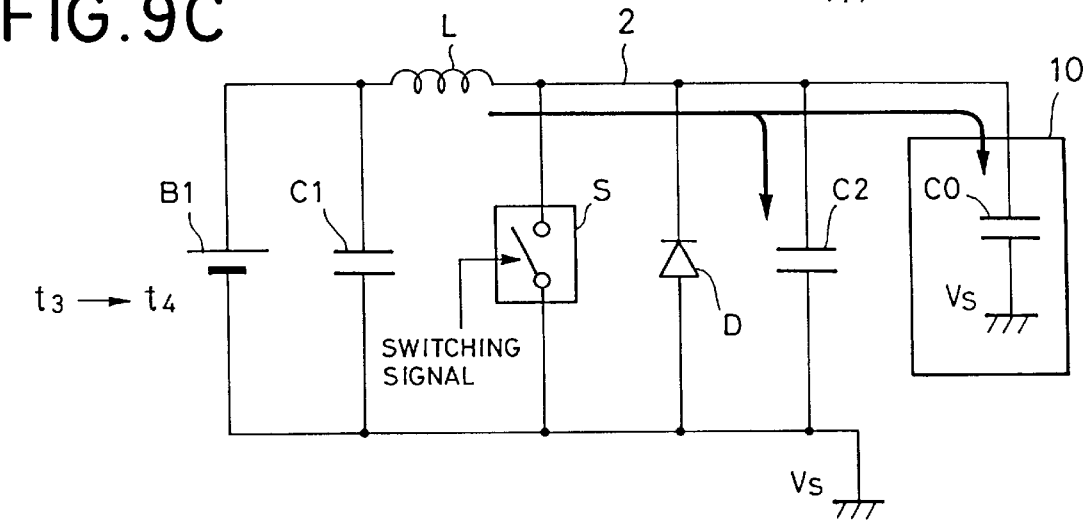
Figure 9D:
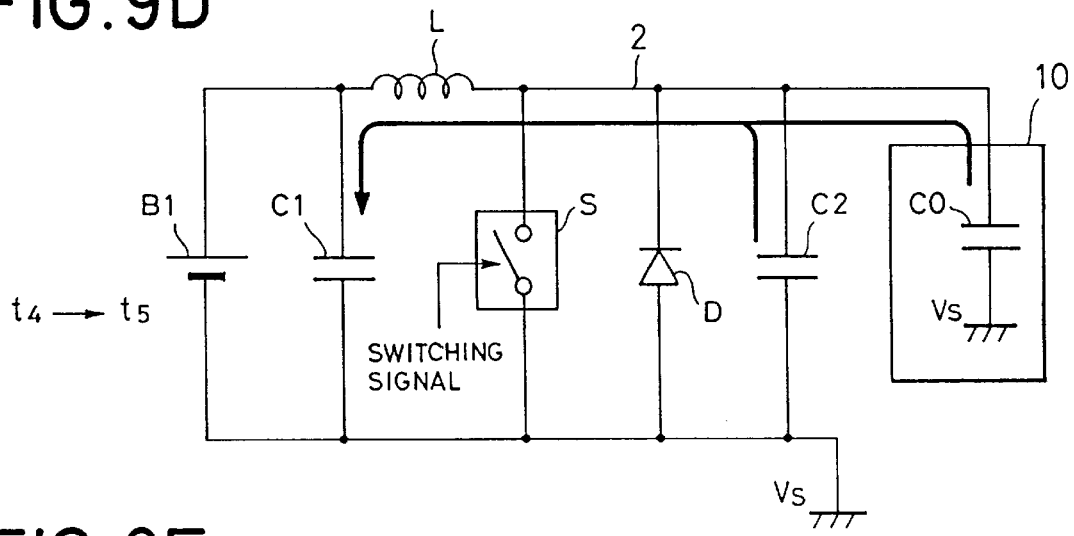

As shown in FIG. 8A, when the switching signal supplied from the drive control circuit 51 is again shifted to the logic level "0", the switching element S is turned off. Consequently, a resonance occurs between the coil L and the capacitor C2 and the load capacitance C0 of the PDP 10 as shown in FIGS. 9C and 9D. In this resonance operation, firstly the energy accumulated in the coil L is released until the energy accumulated in the coil L equals 0, namely, the current flowing on the line 2 becomes equal to 0 (time point $t_4$), so that the capacitor C2 and load capacitance C0 are charged. By the charging operation to the capacitor C2 and load capacitance C0, the electric potential on the line 2 gradually increases as shown in FIG. 8C.

The discharge of the capacitor C2 and the load capacitance C0 starts when the energy accumulated in the coil L equals 0 and the flowing current crosses "0" at the time point $t_4$ shown in FIG. 8B. By the discharge, as a bold arrow in FIG. 9D shows, a current flows along a path of: the capacitor C2 and load capacitance C0 -coil L -capacitor C1. In this case, the capacitor C1 is charged by the current supplied through the coil L and absorbs it. By the charging operation of the capacitor C1, the electric potential on the line 2 gradually decreases as shown in FIG. 8C.

Figure 9E:
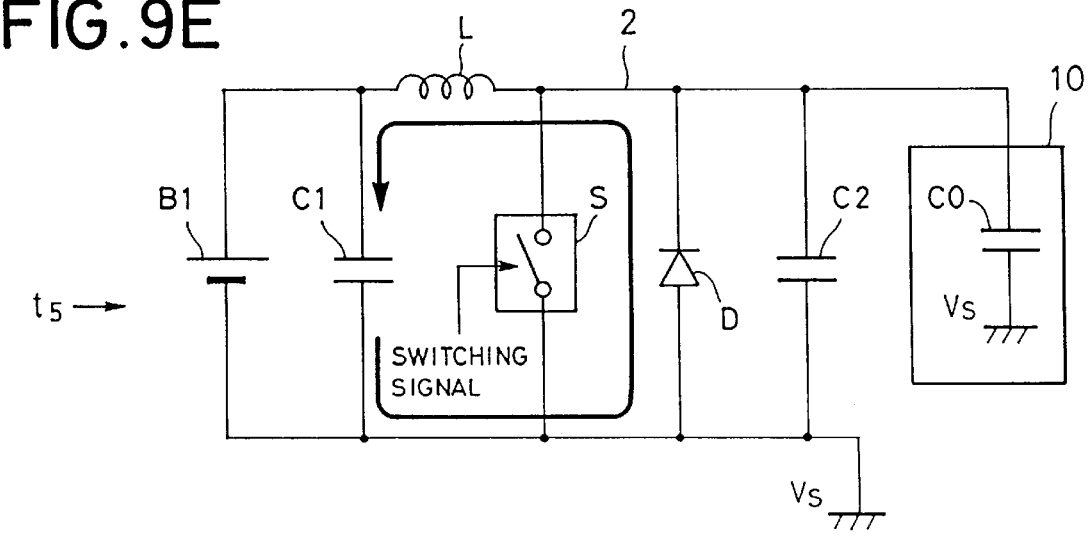

When the electric potential on the line 2 reaches a negative potential, the diode D is biased in the forward direction and a current starts to flow along a path as shown by a bold arrow in FIG. 9E.

By the above series of operations, as shown in FIG. 8C, a sine wave like pulse GP having a peak value VV is generated. The peak value VV is higher than the voltage value which is generated by the DC power source B1.

The pulse GP is, therefore, used as sustaining pulses $IP_y$ and $IP_x$ and pixel data pulse DP as shown in FIGS. 2A to 2F.

Figure 10:
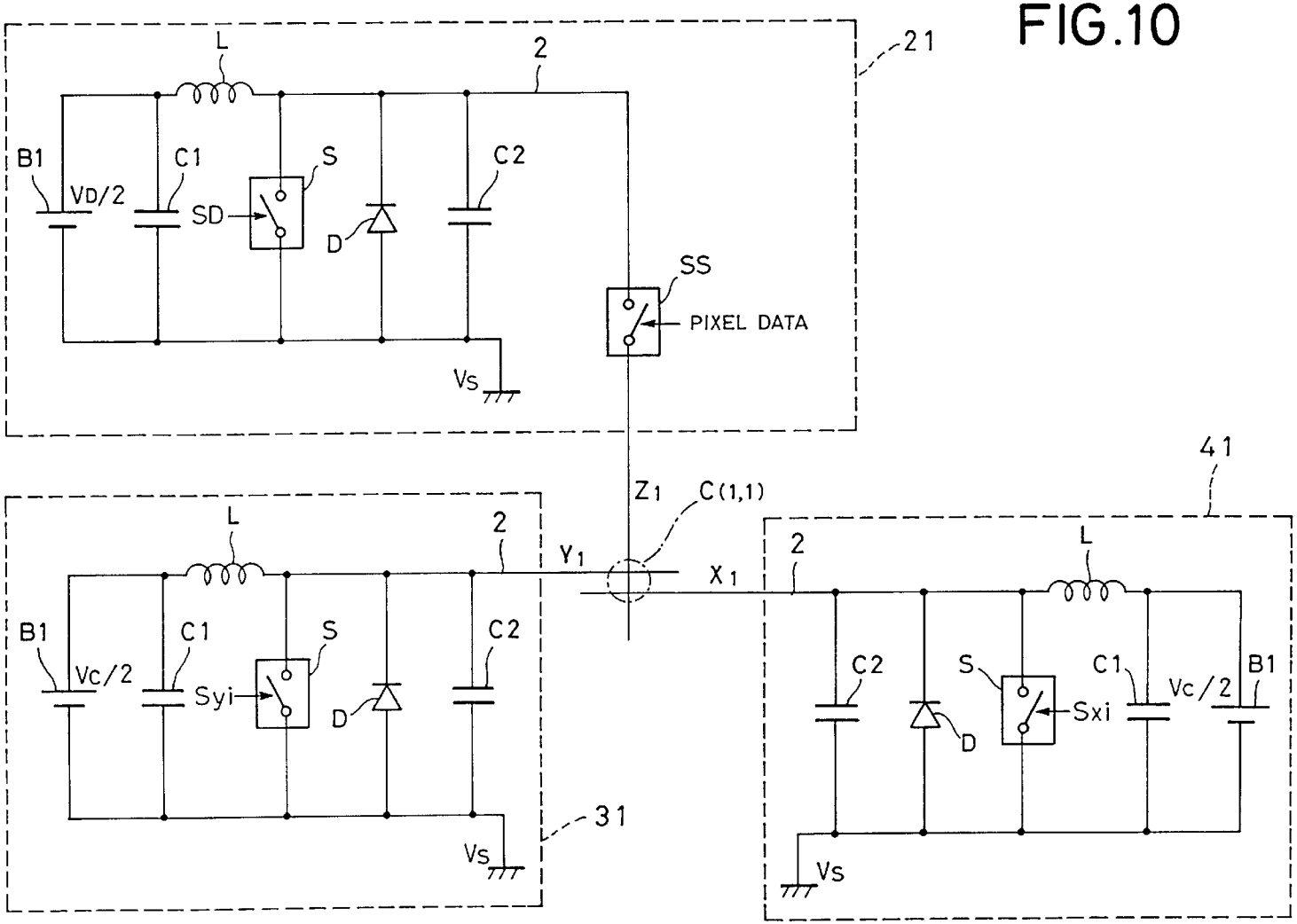
FIG. 10 is a diagram showing an example where the flyback pulse output circuit shown in FIG. 7 is applied as a sustaining pulse generating circuit and a pixel data pulse generating circuit in each of a column electrode driving circuit 21 and row electrode driving circuits 31 and 41.

FIG. 10 is a diagram showing an example of application in which the flyback pulse output circuit shown in FIG. 7 is used as:

a sustaining pulse $IP_y$ generating circuit in the row electrode driving circuit 31;

a sustaining pulse $IP_x$ generating circuit in the row electrode driving circuit 41; and a pixel data pulse DP generating circuit in the column electrode driving circuit 21.

In FIG. 10, among the whole electrodes which the PDP 10 has, only the electrodes to drive the row electrodes $X_1$, $Y_1$, and the column electrodes $Z_1$ are depicted.

Figure 1:
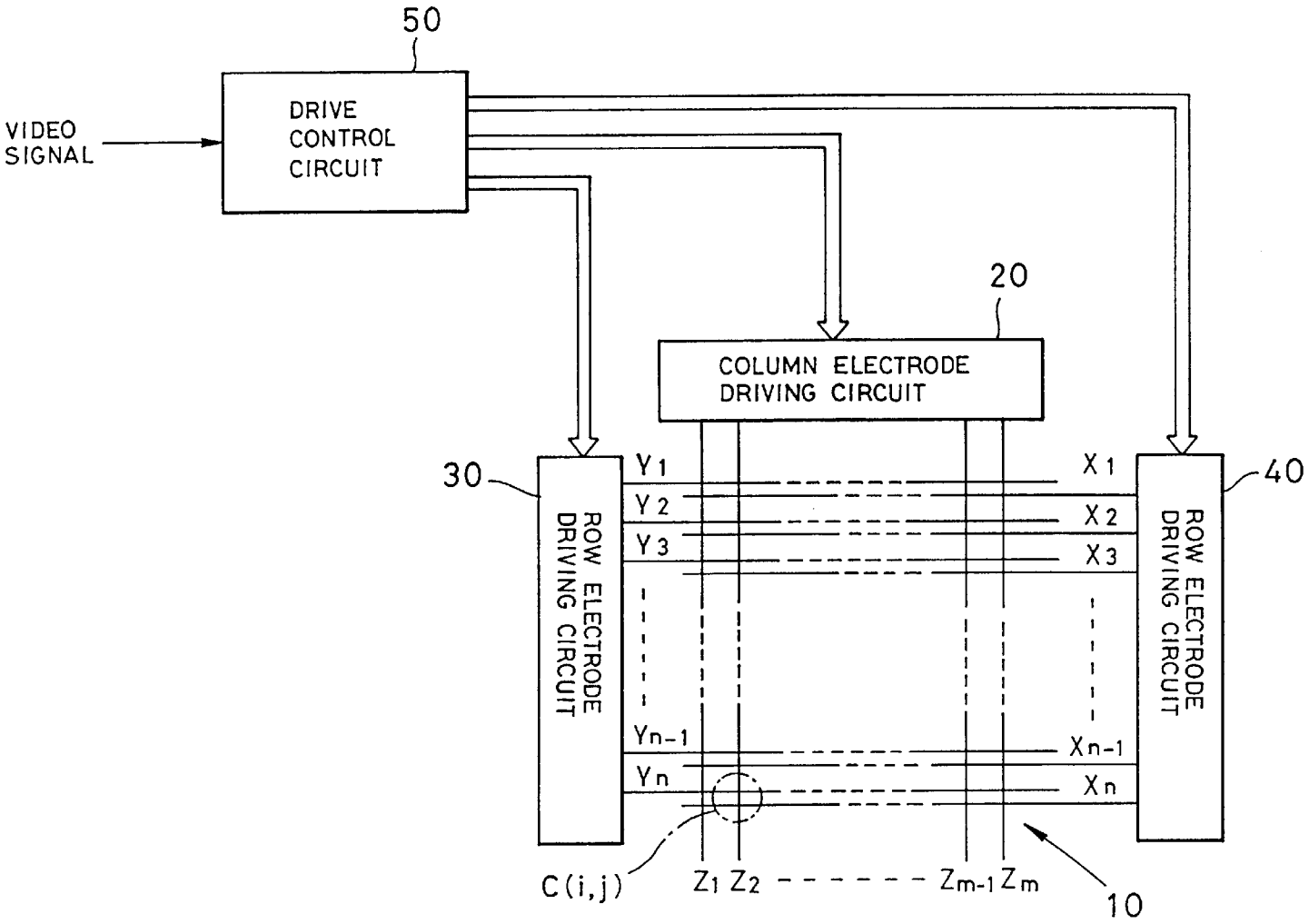
FIG. 1 is a schematic diagram showing the construction of a conventional display apparatus using a flat panel of the self light emitting type.
Figures 11A, 11B, 11C:
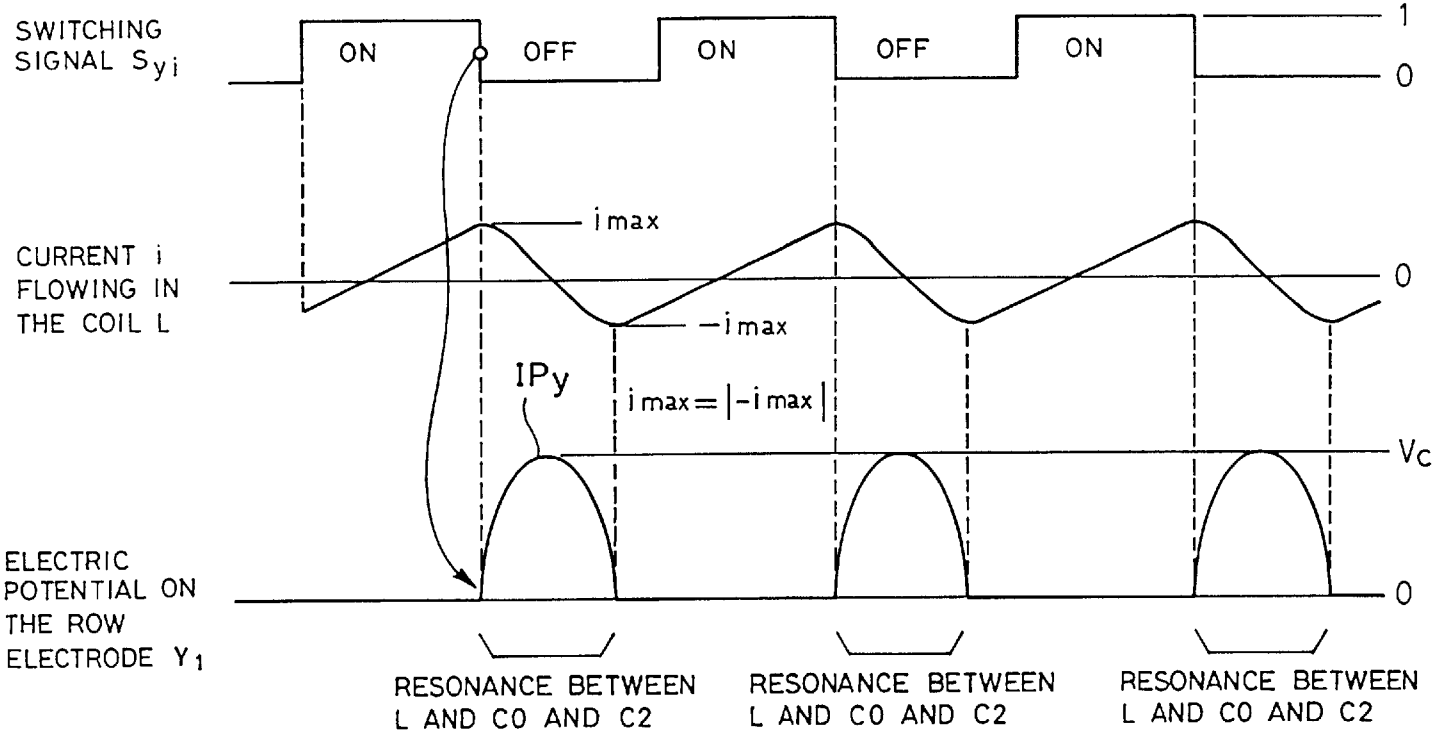
FIGS. 11A to 11C are diagrams showing internal operation waveforms when a sustaining pulse $IP_y$ is generated in a row electrode driving circuit 31 shown in FIG. 10.

When the sustaining pulse $IP_y$ is generated, the drive control circuit 51 supplies a switching signal $S_{yi}$ which repeats the logic levels "0" and "1" as shown in FIG. 11A to the switching element S in the row electrode driving circuit 31 shown in FIG. 10. As shown in FIG. 1C, the sine wave-like sustaining pulse $IP_y$ having a peak value $V_c$ is thus repetitively generated, and is supplied to the row electrode $Y_1$. In this case, the voltage value of the DC power source B1 of the flyback pulse output circuit provided for the row electrode driving circuit 31 may be lower than the peak value $V_c$.

Figures 12A, 12B, 12C:
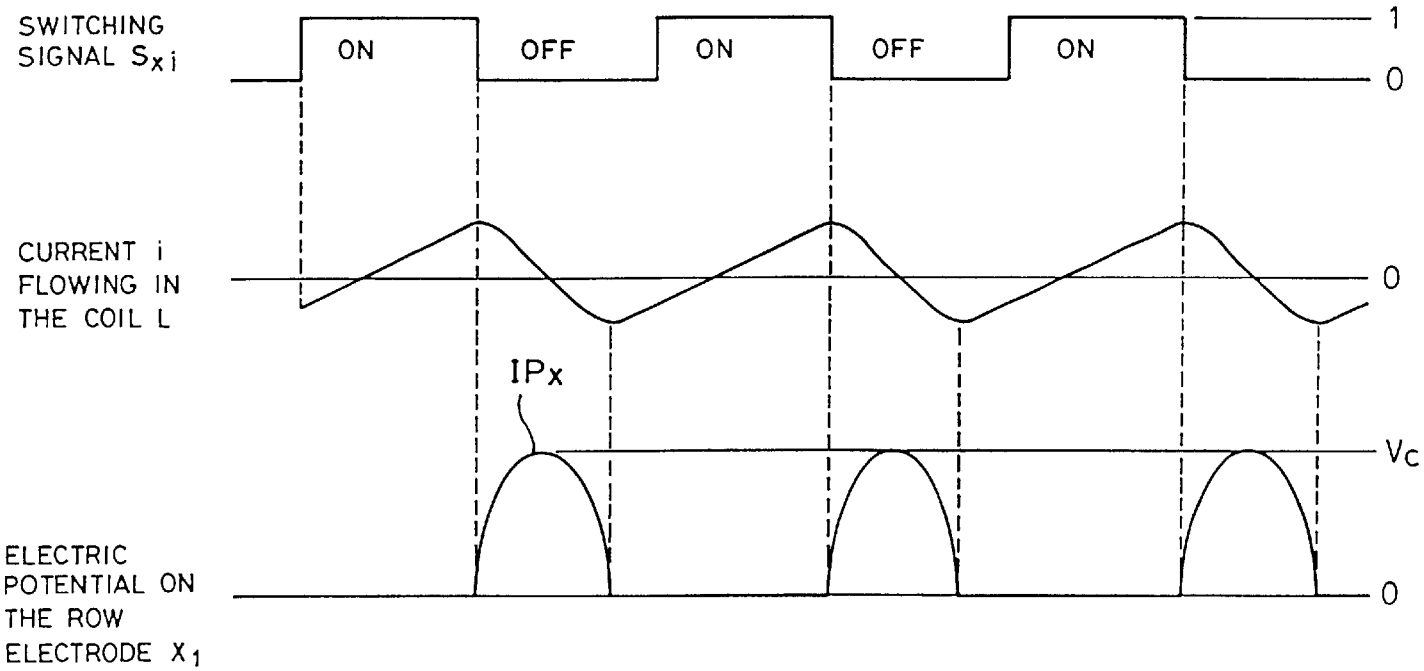
FIGS. 12A to 12C are diagrams showing internal operation waveforms when a sustaining pulse $IP_x$ is generated in the row electrode driving circuit 41 shown in FIG. 10.

When the sustaining pulse $IP_x$ is generated, the drive control circuit 51 supplies a switching signal $S_{xi}$ which repeats the logic levels "0" and "1" as shown in FIG. 12A to the switching element S in the row electrode driving circuit 41 shown in FIG. 10. As shown in FIG. 12C, thus, the sine wave like pulse $IP_x$ having a peak value $V_c$ is repetitively generated and is supplied to the row electrode $X_1$. In this case, it is sufficient that the voltage value of the DC power source B1 of the flyback pulse output circuit provided for the row electrode driving circuit 41 is lower than the peak value $V_c$.

Figures 13A, 13B, 13C, 13D, 13E:
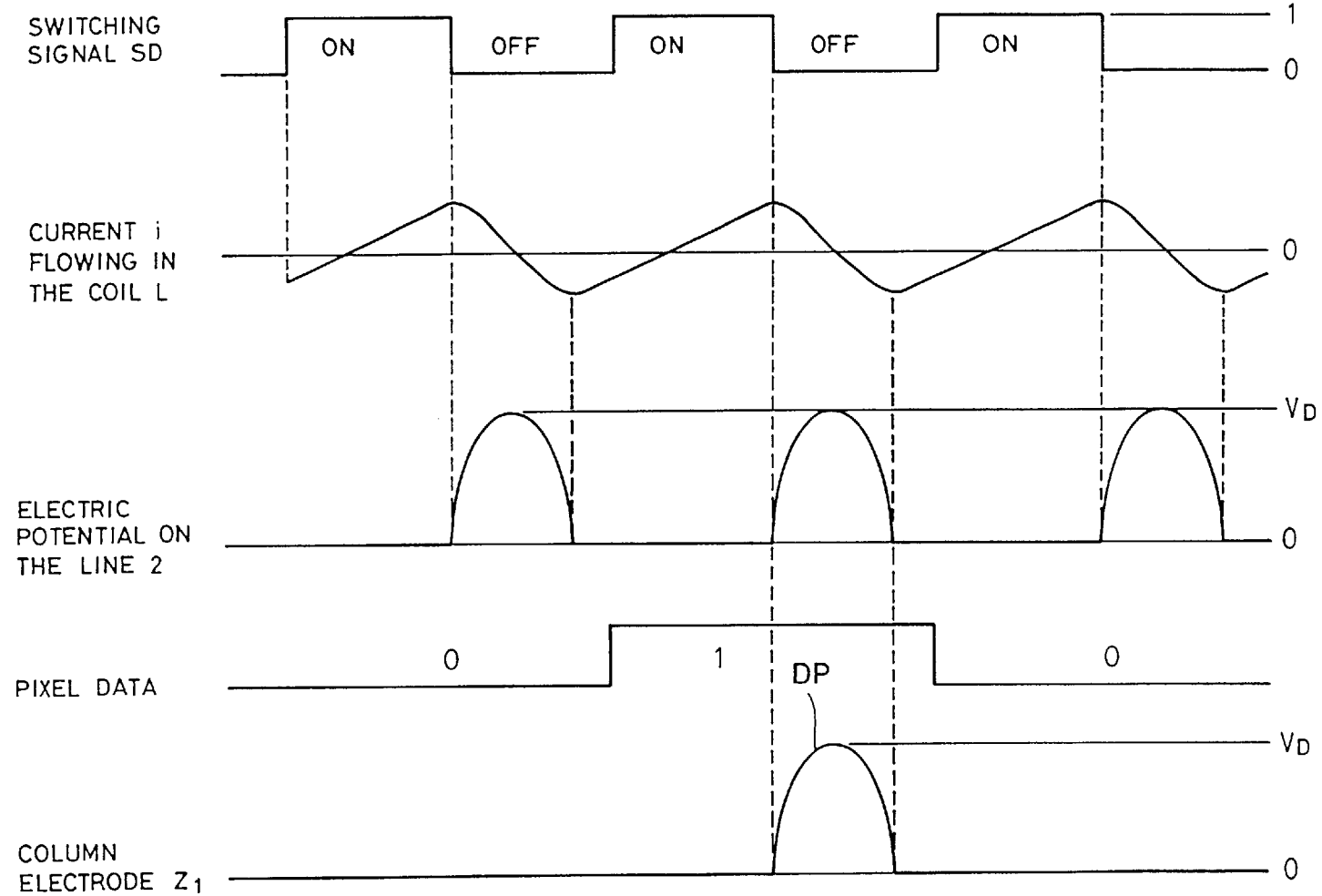
FIGS. 13A to 13E are diagrams showing internal operation waveforms when a pixel data pulse DP is generated in the column electrode driving circuit 21 shown in FIG. 10.

When the pixel data pulse DP is generated, the drive control circuit 51 supplies a switching signal SD which repeats the logic levels "0" and "1" as shown in FIG. 13A to the switching element S in the column electrode driving circuit 21 shown in FIG. 10. As shown in FIG. 13C, the sine wave-like sustaining pulse having a peak value $V_D$ is thus repetitively generated on the line 2. A switching element SS shown in FIG. 10 is placed in the connected state only when the pixel data of the logic level "1" is supplied, thereby allowing the pulse generated on the line 2 to be applied to the column electrode $Z_1$ as a pixel data pulse DP. In this case, the voltage value of the DC power source B1 of the flyback pulse output circuit provided for the column electrode driving circuit 21 may be lower than the peak value $V_D$.

Figure 3:
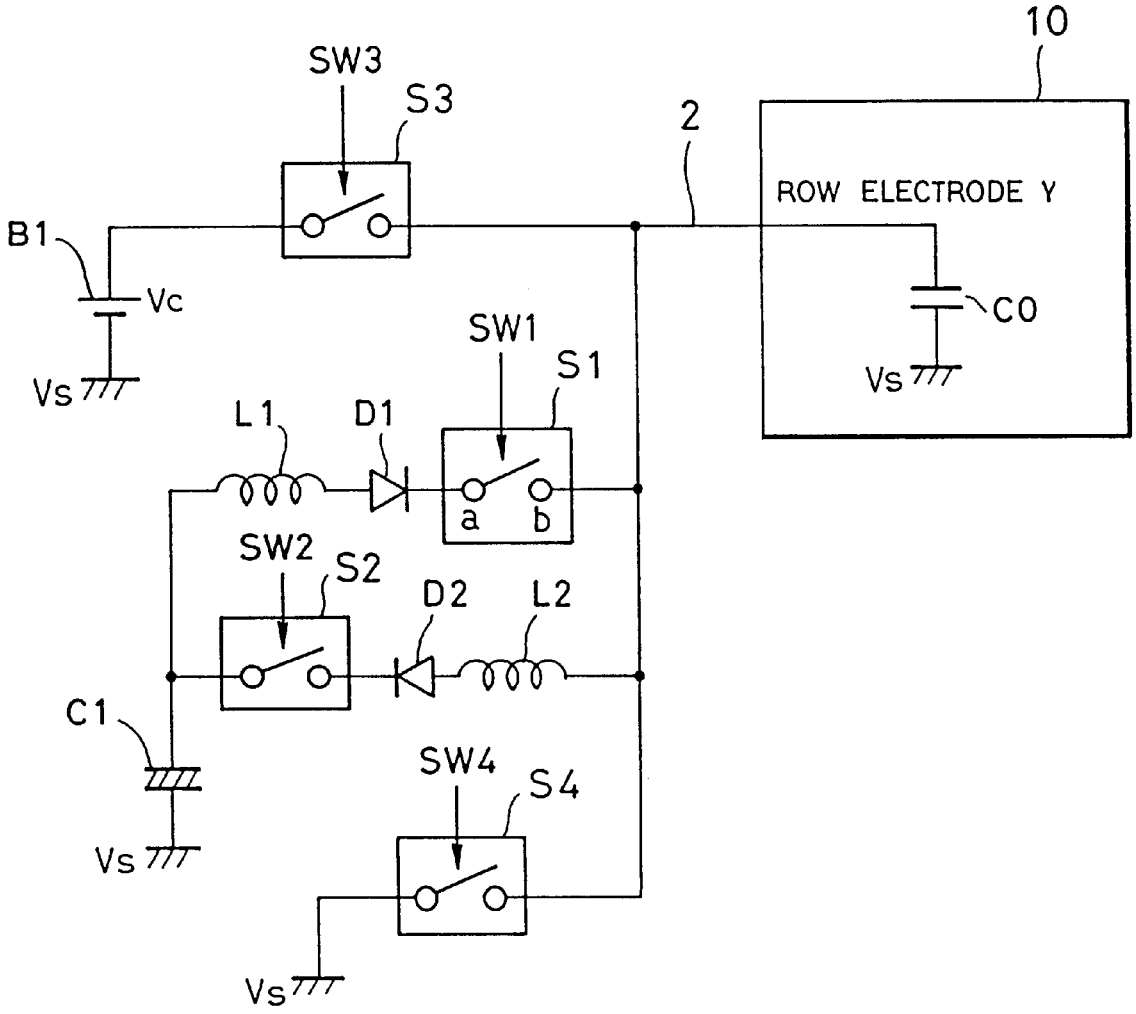
FIG. 3 is a diagram showing a driving pulse generating circuit provided for a row electrode driving circuit 30.
Figures 4A, 4B, 4C, 4D, 4E, 4F, 4G:
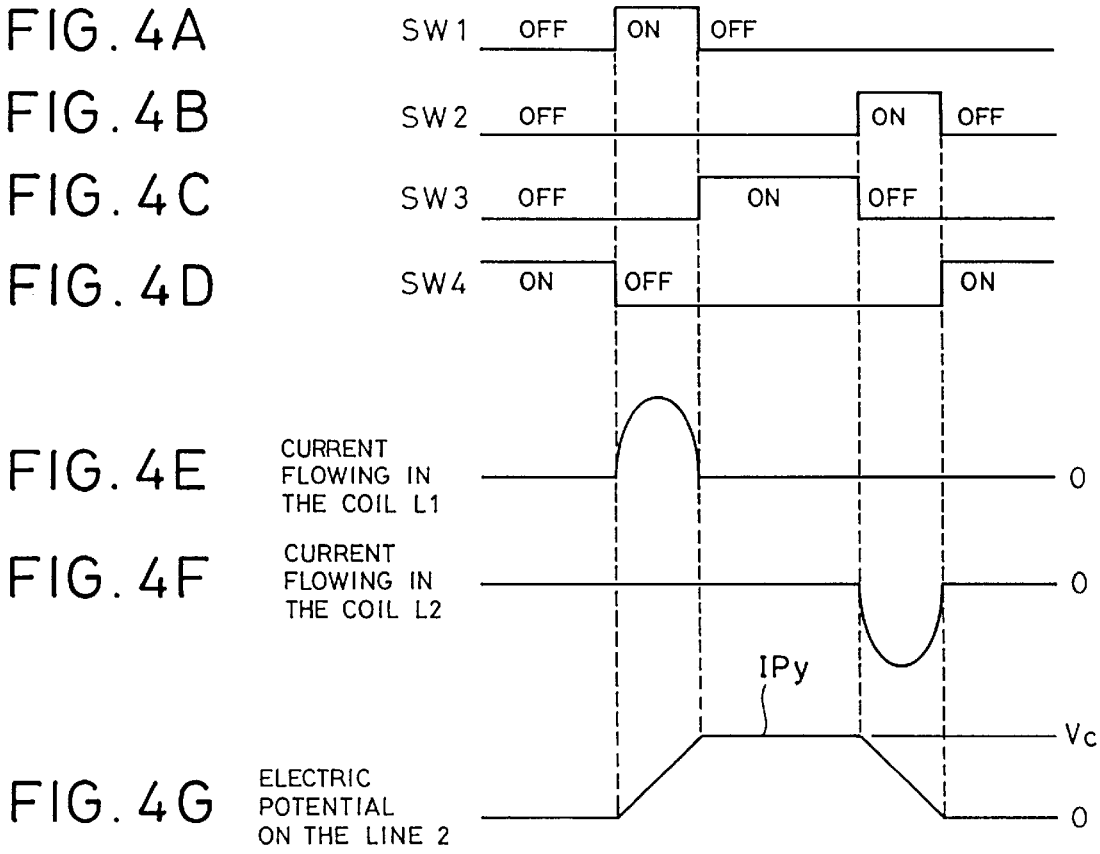
FIGS. 4A to 4G are internal operation waveform diagrams of the driving pulse generating circuit shown in FIG. 3.
Figure 5:
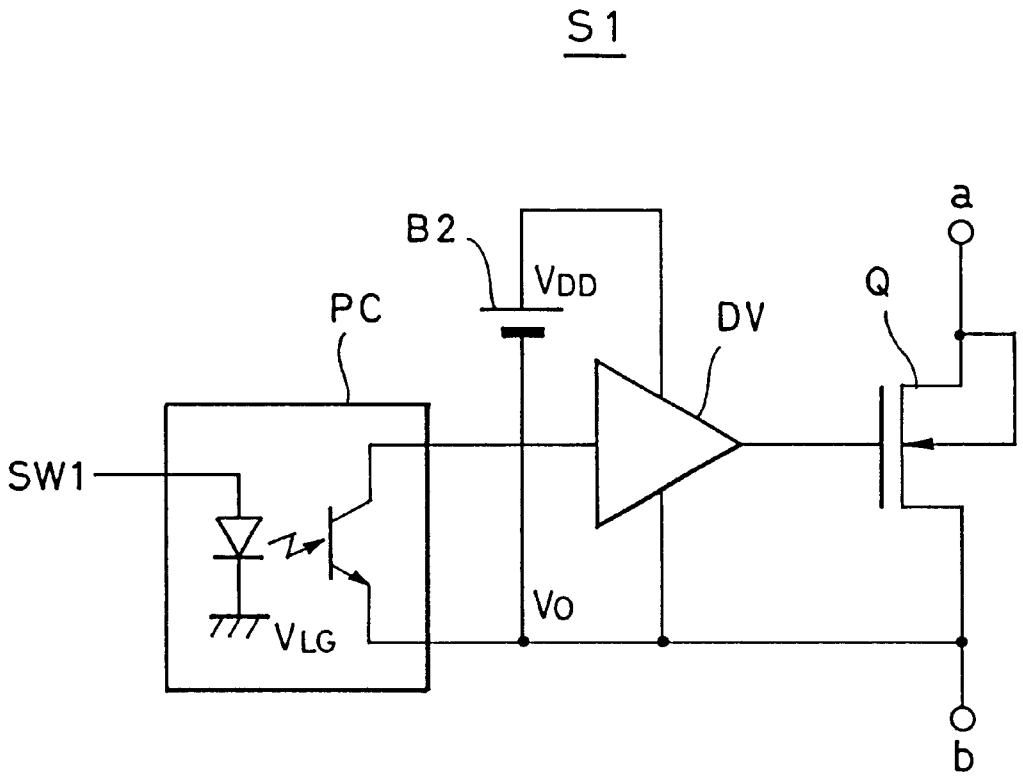
FIG. 5 is a diagram showing a circuit in the case where switching elements S1 to S3 in the driving pulse generating circuit shown in FIG. 3 are formed by MOS transistors.

As mentioned above, according to the flyback pulse output circuit shown in FIG. 7, a low electric power consumption can be realized since the voltage value of the DC power source B1 can be set to be lower than the peak value of each driving pulse. Since one end of the switching element S is set to the grounding potential as shown in FIG. 7, when the switching element S is implemented by a MOS transistor, the additional circuits such as photocoupler PC, power source B2, driver DV, and the like shown in FIG. 5 are no more necessary. Therefore, its circuit scale can be reduced than that of the electrode driving circuit shown in FIG. 3. Moreover, since the number of switching elements which are used can be set to one, the operation can be performed at a higher speed than that of the electrode driving circuit shown in FIG. 3. Since the pulses are generated by using the whole resonance, there is an advantage such that an EMI interference is small.

As described above, according to the flyback pulse output circuit shown in FIG. 7, when driving a large PDP, there is a situation such that the peak value of the driving pulse becomes unstable when the discharge current increases, because of such a cause as insufficiency in the capacitance of the resonance capacitor.

Figure 14:
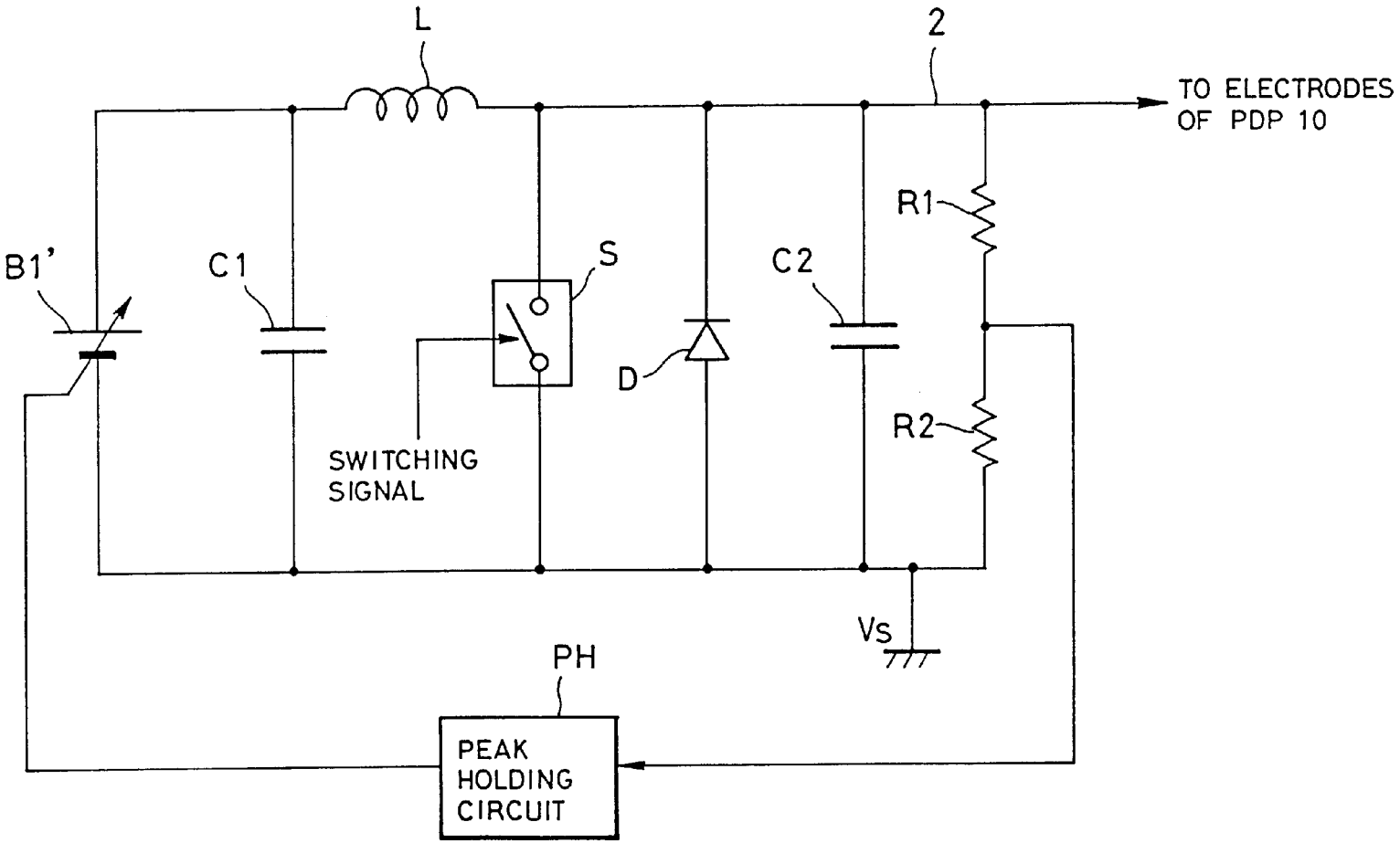
FIG. 14 is a diagram showing a flyback pulse output circuit having a stabilizing circuit.

FIG. 14 is a diagram showing another embodiment of a flyback pulse output circuit which has been devised in consideration of the above problems.

In the flyback pulse output circuit shown in FIG. 14, peak voltage value detecting means that comprises a peak holding circuit PH and resistors R1 and R2 is added to the circuit shown in FIG. 7. In addition, the DC power source B1 is changed to a variable DC power source B1'. The peak holding circuit PH detects and holds a peak voltage value of the voltage generated on the line 2 based on a value in which a potential difference caused between the line 2 and PDP grounding potential $V_s$ is divided by the resistors R1 and R2. The peak holding circuit PH supplies the peak voltage value to the variable DC power source B1'. According to the peak voltage value, the variable DC power source B1' generates a DC power voltage and applies it across the capacitor C1.

With the above construction, the value of the DC power voltage generated in the variable DC power source B1' is adjusted so that the peak value of the driving pulse generated on the line 2 is always stabilized to desired predetermined value. That is, the peak value of the driving pulse is successively detected and the value of the power voltage generated in the variable DC power source B1' is adjusted by an amount corresponding to the detected peak value. The peak value of the driving pulse is stabilized in this way.

Instead of adjusting the power voltage value, it is also possible to adjust a ratio between a connection time period and a disconnection time period in the switching element S in accordance with the peak voltage value.

Figure 15:
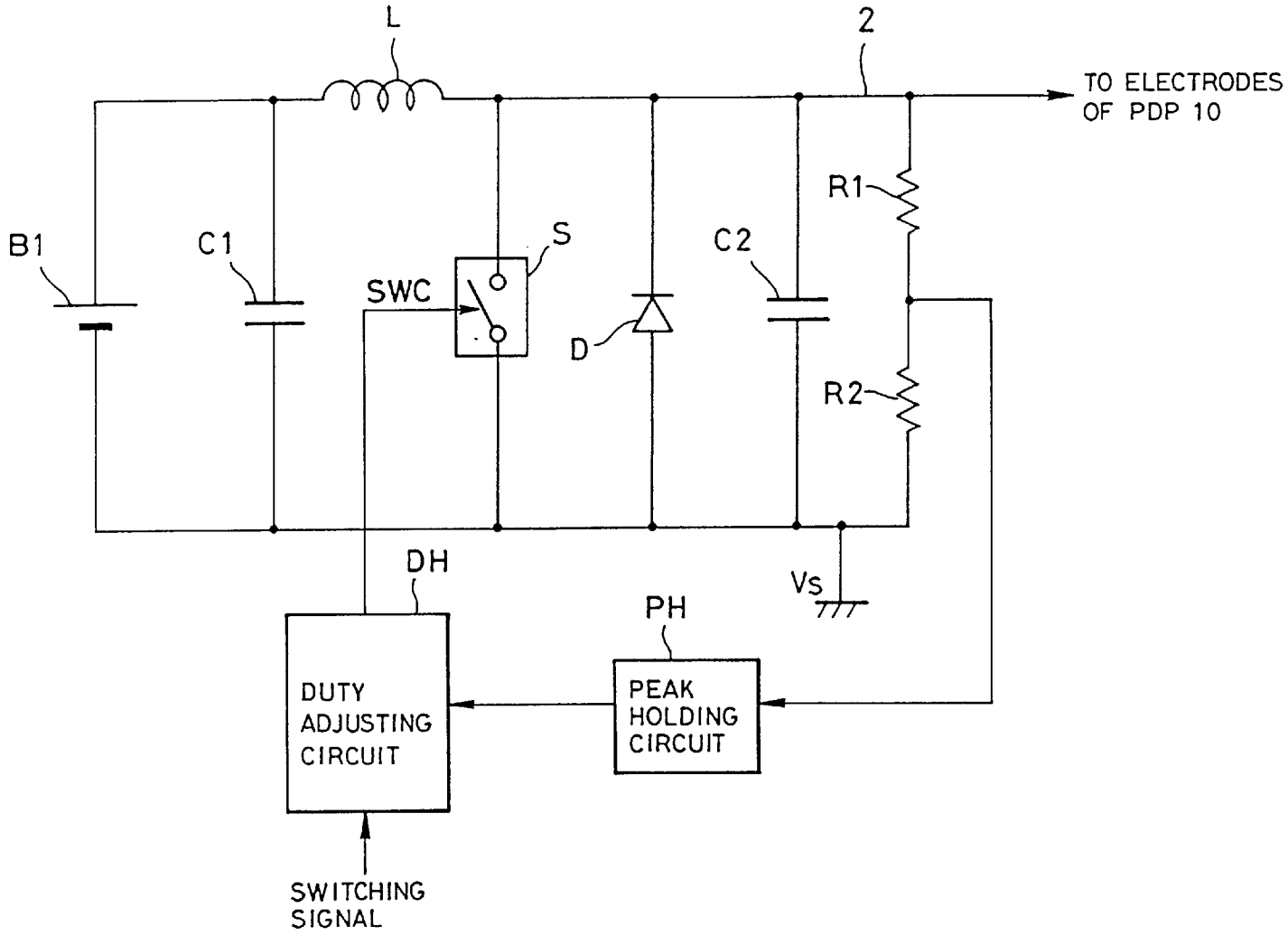
FIG. 15 is a diagram showing another construction of a flyback output circuit having a stabilizing circuit.
Figures 16A, 16B, 16C, 16D:
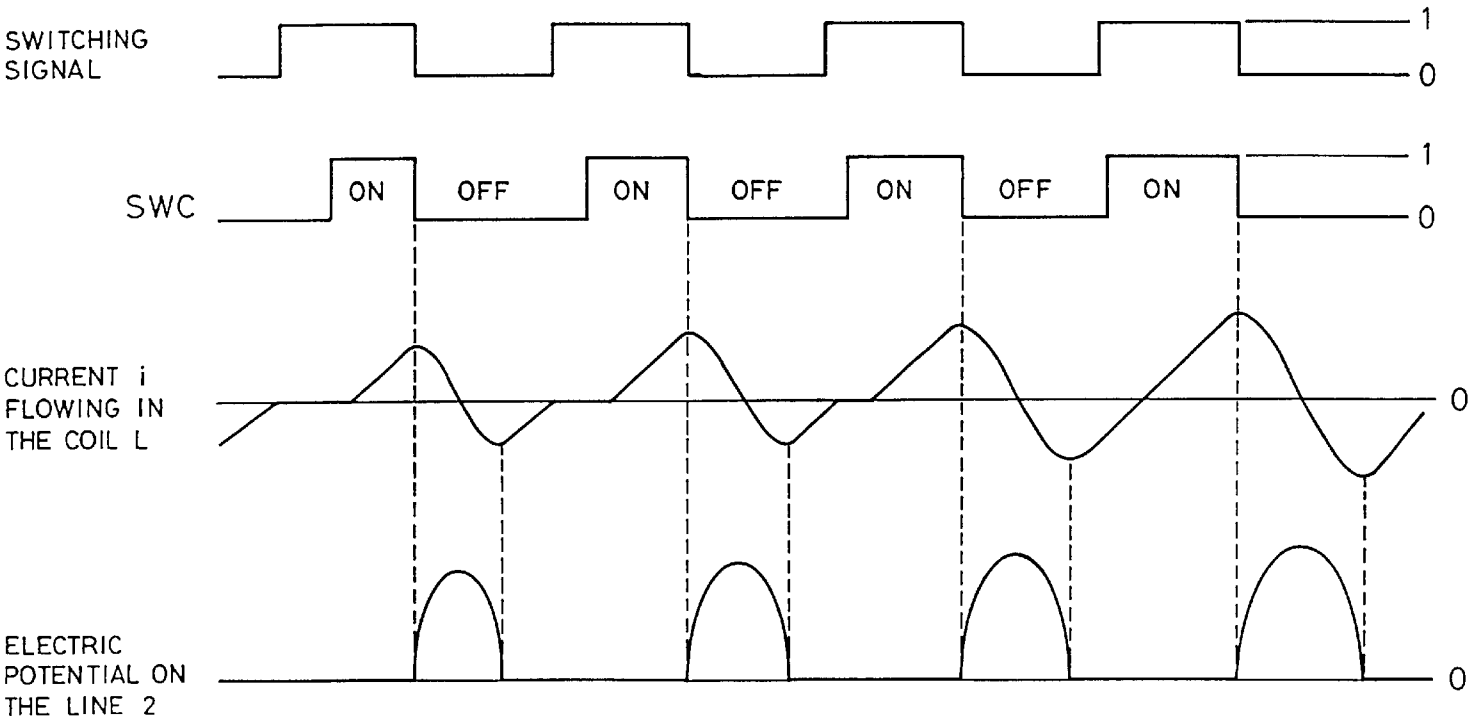
FIGS. 16A to 16D are diagrams showing operation waveforms when a peak value of a driving pulse is adjusted by controlling a duty ratio of a switching signal by the circuit shown in FIG. 15.

FIG. 15 is a diagram showing a further embodiment of the flyback pulse output circuit devised in consideration of the above problems.

In the flyback pulse output circuit shown in FIG. 15, the peak holding circuit PH and resistors R1 and R2 which are similar to those in FIG. 14 and a duty adjusting circuit DH are added to the circuit shown in FIG. 7. The duty adjusting circuit DH adjusts a duty ratio of the switching signal supplied from the drive control circuit 51 based on the peak voltage value supplied from the peak holding circuit PH and supplies a duty-adjusted switching signal SWC to the switching element S. That is, a ratio between the period in which the switching element S is connected and the period in which it is disconnected is adjusted in accordance with the peak value.

With the above described construction, for instance, when the peak value of the driving pulse generated on the line 2 is lower than a desired value, the duty adjusting circuit DH prolongs the connection period of time of the switching element S, thereby adjusting the duty ratio of the switching signal. In this case, as shown in FIGS. 16A to 16D, the longer the period of time of the connection state of the switching element S, the larger an amount of current flowing in the coil L and the peak value of the driving pulse generated on the line 2.

Figures 17A, 17B, 17C:
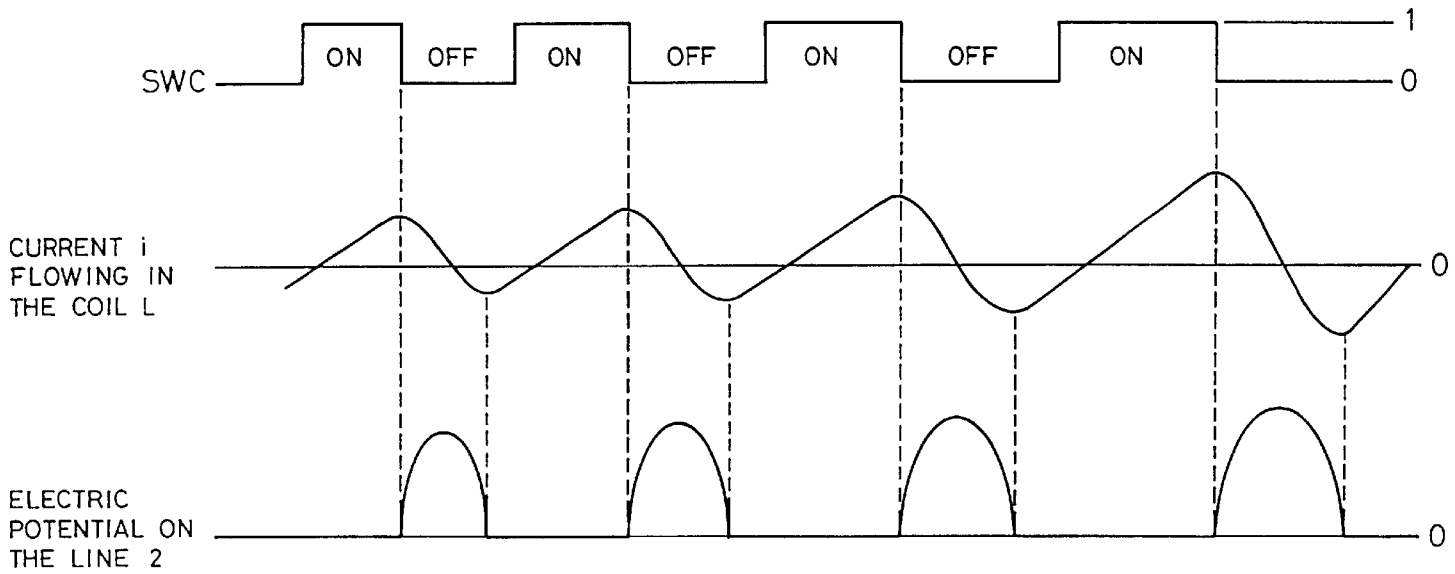
FIGS. 17A to 17C are diagrams showing operation waveforms when the peak value of the driving pulse is adjusted by controlling a period of the switching signal by the circuit shown in FIG. 15.

Instead of adjusting the ratio between the connection period and the disconnection period in the switching element S, the peak value of the driving pulse can be also similarly controlled by adjusting a switching period of time of the connection and the disconnection as shown in FIGS. 17A to 17C.

In this case, as shown in FIGS. 17A to 17C, the longer the switching period of time of the connection and the disconnection in the switching element S, the larger an amount of current flowing in the coil L increases and the peak value of the driving pulse generated on the line 2.

According to the display panel driving apparatus of the invention as described in detail above, various driving pulses are generated by the operation in which the whole resonance is used, by using the resonance circuit which comprises the capacitor and the coil.

According to the above construction, therefore, since various driving pulses can be generated by the DC power source having a voltage value lower than the peak value of the driving pulse to be generated, the low electric power consumption can be realized. Since it is sufficient to set the number of switching means which are used to one, a small scale of the circuit and a high speed operation can be realized. Furthermore, since the driving pulse is generated by using the whole resonance, there is an advantage such that the EMI interference is reduced.

What is claimed is:

1. A driving apparatus for generating a driving pulse to be applied to each of a plurality of row electrodes and a plurality of column electrodes of a display panel, said plurality of column electrodes being arranged to be perpendicular to said row electrodes, comprising:

a DC power source for generating a DC voltage;

a first capacitor connected in parallel with said DC power source;

a coil with one end directly connected to a positive side terminal of said DC power source;

a switch operable to alternately perform a connection and a disconnection between a second end of said coil and a negative side terminal of said DC power source;

a diode whose cathode is connected to the other end of said coil and whose anode is connected to the negative side terminal of said DC power source; and a second capacitor connected in parallel with said diode, wherein a potential change at the second end of said coil is outputted as said driving pulse.

2. An apparatus according to claim 1, further comprising:

a peak voltage value detector operable to detect a peak voltage value of said driving pulse; and a stabilizer operable to maintain a peak value of said driving pulse at a predetermined value in accordance with said peak voltage value.

3. An apparatus according to claim 1, wherein said driving pulse is a sustaining pulse which is applied to said row electrodes.

4. An apparatus according to claim 1, wherein said driving pulse is a pixel data pulse which is applied to said column electrodes.

5. A driving apparatus for generating a driving pulse to be applied to each of a plurality of row electrodes and a plurality of column electrodes of a display panel, said plurality of column electrodes being arranged to be perpendicular to said row electrodes, comprising:

a DC power source for generating a DC voltage, wherein said DC power source is a variable DC power source which can vary a voltage value of said DC voltage;

a first capacitor connected in parallel with said DC power source;

a coil with one end directly connected to a positive side terminal of said DC power source, wherein a potential change at the second end of said coil is outputted as said driving pulse;

a switch operable to alternately perform a connection and a disconnection between a second end of said coil and a negative side terminal of said DC power source;

a diode whose cathode is connected to the other end of said coil and whose anode is connected to the negative side terminal of said DC power source;

a second capacitor connected in parallel with said diode;

a peak voltage value detector operable to detect a peak voltage value of said driving pulse; and a stabilizer operable to maintain a peak value of said driving pulse at a predetermined value in accordance with said peak voltage value, and further operable to change a value of said DC voltage to be generated by said variable DC power source in accordance with said peak voltage value.

6. A driving apparatus for generating a driving pulse to be applied to each of a plurality of row electrodes and a plurality of column electrodes of a display panel, said plurality of column electrodes being arranged to be perpendicular to said row electrodes, comprising:

a DC power source for generating a DC voltage;

a first capacitor connected in parallel with said DC power source;

a coil with one end directly connected to a positive side terminal of said DC power source;

a switch operable to alternately perform a connection and a disconnection between a second end of said coil and a negative side terminal of said DC power source; and a second capacitor connected in parallel with said diode, wherein a potential change at the second end of said coil is outputted as said driving pulse and a ratio between a period of time of said connection and a period of time of said disconnection in said switch is adjusted in accordance with said peak voltage value.

7. A driving apparatus for generating a driving pulse to be applied to each of a plurality of row electrodes and a plurality of column electrodes of a display panel, said plurality of column electrodes being arranged to be perpendicular to said row electrodes, comprising:

a DC power source for generating a DC voltage;

a first capacitor connected in parallel with said DC power source;

a coil with one end directly connected to a positive side terminal of said DC power source, wherein a potential change at the second end of said coil is outputted as said driving pulse;

a switch operable to alternately perform a connection and a disconnection between a second end of said coil and a negative side terminal of said DC power source;

a diode whose cathode is connected to the other end of said coil and whose anode is connected to the negative side terminal of said DC power source;

a second capacitor connected in parallel with said diode;

a peak voltage value detector operable to detect a peak voltage value of said driving pulse; and a stabilizer operable to maintain a peak value of said driving pulse at a predetermined value in accordance with said peak voltage value, wherein said stabilizer adjusts a ratio between a period of time of said connection and a period of time of said disconnection in said switch in accordance with said peak voltage value.

8. A driving apparatus for generating a driving pulse to be applied to each of a plurality of row electrodes and a plurality of column electrodes of a display panel, said plurality of column electrodes being arranged to be perpendicular to said row electrodes, comprising:

a DC power source for generating a DC voltage;

a first capacitor connected in parallel with said DC power source;

a coil with one end directly connected to a positive side terminal of said DC power source, wherein a potential change at the second end of said coil is outputted as said driving pulse;

a switch operable to alternately perform a connection and a disconnection between a second end of said coil and a negative side terminal of said DC power source;

a diode whose cathode is connected to the other end of said coil and whose anode is connected to the negative side terminal of said DC power source; and a second capacitor connected in parallel with said diode, wherein a switching period of said connection and said disconnection in said switch is adjusted in accordance with said peak voltage value.

9. A driving apparatus for generating a driving pulse to be applied to each of a plurality of row electrodes and a plurality of column electrodes of a display panel, said plurality of column electrodes being arranged to be perpendicular to said row electrodes, comprising:

a DC power source for generating a DC voltage;

a first capacitor connected in parallel with said DC power source;

a coil with one end directly connected to a positive side terminal of said DC power source, wherein a potential change at the second end of said coil is outputted as said driving pulse;

a switch operable to alternately perform a connection and a disconnection between a second end of said coil and a negative side terminal of said DC power source;

a diode whose cathode is connected to the other end of said coil and whose anode is connected to the negative side terminal of said DC power source;

a second capacitor connected in parallel with said diode;

a peak voltage value detector operable to detect a peak voltage value of said driving pulse; and a stabilizer operable to maintain a peak value of said driving pulse at a predetermined value in accordance with said peak voltage value, wherein said stabilizer adjusts a switching period of said connection and said disconnection in said switch in accordance with said peak voltage value.

* * * * *